US005947072A

United States Patent [19]

Loy et al.

[11] Patent Number: 5,947,072

[45] Date of Patent: Sep. 7, 1999

[54] INLET DEVICE FOR AN INTERNAL COMBUSTION ENGINE

[75] Inventors: Roland Loy, Illingen; Heinz Andress, Erdmannshausen; Heinz Mueller, Remseck, all of Germany

[73] Assignee: Filterwerk Mann & Hummel GmbH, Ludwigsburg, Germany

[21] Appl. No.: 08/875,167

[22] PCT Filed: Jan. 17, 1996

[86] PCT No.: PCT/EP96/00174

§ 371 Date: Sep. 15, 1997

§ 102(e) Date: Sep. 15, 1997

[87] PCT Pub. No.: WO96/22462

PCT Pub. Date: Jul. 25, 1996

[30] Foreign Application Priority Data

Jan. 19, 1995 [DE] Germany ..... 195 01 411

[51] Int. Cl.[6] ..... F02M 35/108

[52] U.S. Cl. ..... 123/184.56; 123/184.53

[58] Field of Search ..... 123/184.56, 184.53, 123/184.21, 188.5; 251/343; 181/229

[56] References Cited

U.S. PATENT DOCUMENTS 5,749,342 5/1998 Chao ..... 123/184.56

FOREIGN PATENT DOCUMENTS 369784 3/1932 United Kingdom ..... 123/184.53

*Primary Examiner*—Noah P. Kamen
*Assistant Examiner*—Jason Benton
*Attorney, Agent, or Firm*—Evenson, McKeown, Edwards & Lenahan, P.L.L.C.

[57] ABSTRACT

The invention concerns an air inlet device for an internal combustion engine. The inlet device in question is provided with an at least partially variable through-aperture by which the inlet behavior is matched to the operating condition of the engine. To achieve an optimal reduction in noise emission depending on the operating conditions of the engine, the inlet device (1) includes at least one inner tube (3) and one outer tube (4). The inlet air stream is drawn irrespective of prevailing operating conditions through the inner tube (3) and a further air stream is drawn through an additional through-aperture whose size can be varied, between the inner tube (3) and outer tube (4). The additional through-aperture is provided with a resilient sealing lip (7, 13).

16 Claims, 5 Drawing Sheets

INLET DEVICE FOR AN INTERNAL COMBUSTION ENGINE

The invention relates to an air intake device for an internal combustion engine having an at least partially variable orifice for adapting the air intake to the operating conditions of the internal combustion engine.

STATE OF THE ART

An air intake device for an internal combustion engine is already disclosed in DE-OS 40 41 786, in which a controllable shut-off means is present for varying the aperture through which the aspirated air flows. The shut-off means is situated in a cross passage between two air aspirating passages and is opened or closed by commands from an electronic controller. The commands are dependent upon the rotary speed of the internal combustion engine and upon the temperature of the outside air, which is determined by a temperature sensor.

The invention is addressed to the problem of developing an air intake device for an internal combustion engine having an at least partially variable orifice for adapting the air intake to the operating conditions of the internal combustion engine, such that, with simple means, and without additional control devices, an adaptation of the orifice of the air intake device to the conditions of operation of the internal combustion engine will be possible.

ADVANTAGES OF THE INVENTION

The air intake device according to the invention solves the stated problem by the air intake device having at least one inner tube and one outer tube, whereby the aspirated air stream passes in every state of operation through the inner tube, and an additional air stream passes through a supplemental orifice of variable size in the area between the inner tube and the outer tube.

The air intake device according to the invention is especially advantageous because the emission of noise, especially, is greatly diminished in a simple manner by matching the size of the aperture admitting the volume of air to the engine speed. A particular size of the aperture is optimum for each speed of the internal combustion engine, a small diameter at low speeds leading to a minimum emission of noise.

According to the invention, at lower speeds, i.e., at a low air intake volume, only the inner tube is open, and not until the engine speed or intake air volume increases is a variably expandable airway added between the inner tube and the outer tube. When a plurality of inner tubes is used, the variable supplemental airways can also be provided between the additional inner tubes. The structural configurations of the variable air intake apertures described hereinafter are all equally applicable in each case.

The variable airway apertures are realized in a simple manner by means of a passive flap valve mechanism, which is formed in the area between the tubes which is set by fin-like spacing means. To open the valve mechanism all that is needed in this case is an increase in the aspiration pressure, for example, when the speed of the internal combustion engine increases.

In an especially advantageous manner the flap valve mechanism is made in the form of a resilient sealing lip which is fixed at one end and in the free portion it can be moved away from the other tube surface such that it partially or entirely opens the supplemental airway aperture. This resilient sealing lip is preferably made from a temperature-stable elastic material, e.g., an elastomer, TPE or the like, so that the opening action is largely independent of temperature. The free, movable parts of the sealing lip are made as long as possible, in this case, in order to promote temperature independence.

To improve the opening action the resilient sealing lip is additionally slit at the free end, so that the free parts will be still more movable. Any needed pressure of the free part against the other tube can be brought about simply by an annular spring.

The additionally possible geometric embodiments of the resilient sealing lip and the best arrangement in each case, either at the intake opening, at the outlet opening or in between, will depend on the particular application, which is determined by the type and/or conditions of the use of the internal combustion engine.

It is furthermore advantageous if the at least one inner tube is slightly longer than the outer tube and thus protrudes out of the plane of the intake opening. In this manner turbulence and pressure drop in the additional airway opening, which negatively affect the intake of air, can be largely avoided.

DRAWINGS

Embodiments of the air intake device according to the invention are explained with reference to the drawings, in which.

DESCRIPTION OF THE EMBODIMENTS

Figure 1:
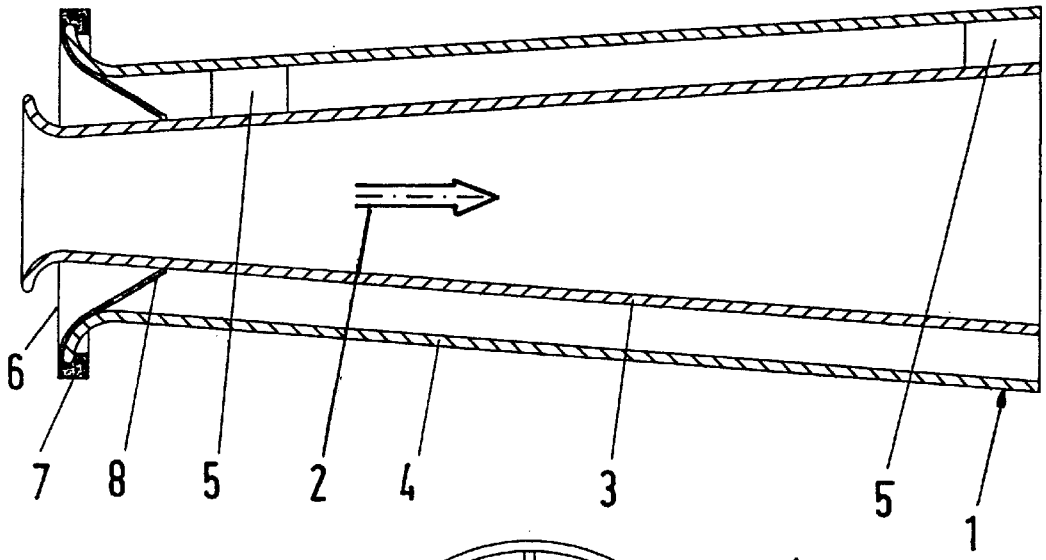
FIG. 1 is a section taken through a first embodiment of an air intake device with an inner tube and an outer tube and a resilient sealing lip.

In FIG. 1 there is shown an air intake device 1 for a combustion engine—not illustrated here—through which an air stream indicated by arrow 2 is aspirated. The air intake device 1 has an inner tube 3, an outer tube 4, and fin-like spacers 5 between the tubes 3 and 4. The inner tube 3 is in this case extended by a certain amount beyond the plane of the intake opening 6. Although in this and the following drawings only one inner tube 3 is present, it is possible in principle to provide a plurality of inner tubes 3 configuring additional, variable orifices with the respective outer tubes.

A resilient sealing lip 7 is mounted on the outer tube at the intake opening 6 and has a portion 8 that is freely movable within limits. The sealing lip 7 with the free portion 8 slopes rearwardly, so that in the event of a specific increase in the aspiration pressure the free portion 8 of the sealing lip 7 will move away from the inner tube 3 and opens an additional aperture for the passage of the air stream.

Figure 2:
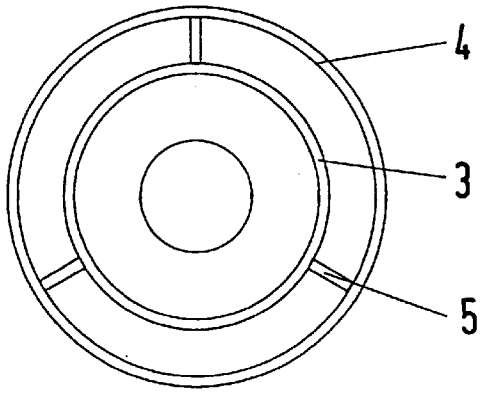
FIG. 2 is a section through the air intake device according to FIG. 1.

In FIG. 2 there is shown a section through the air intake device of FIG. 1, which shows especially the position of the fin-like spacers 5 between the tubes 3 and 4.

Figure 3:
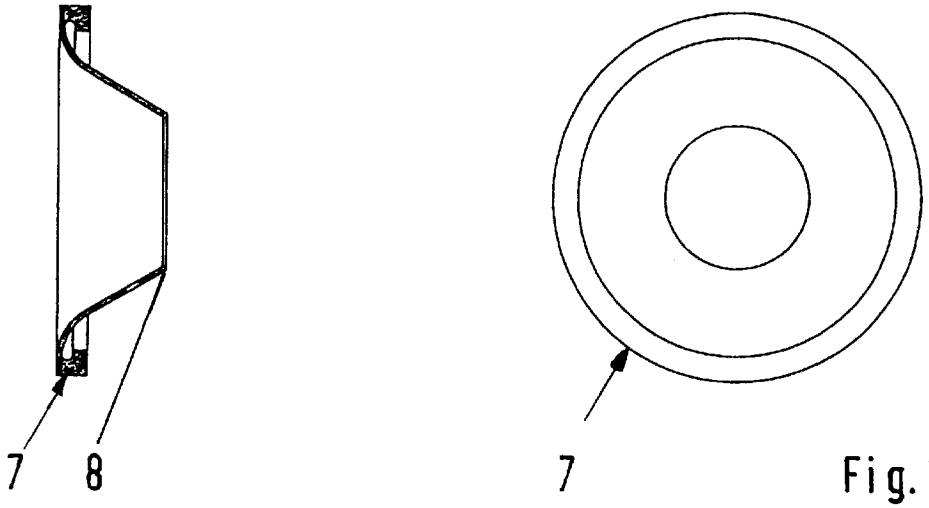
FIGS. 3 to 8 are different embodiments of the resilient sealing lip.

FIG. 3 shows in detail a first embodiment of the sealing lip 7 with the movable free portion 8, the right half of FIG. 3 showing a frontal view of the sealing lip 7.

Figure 4:
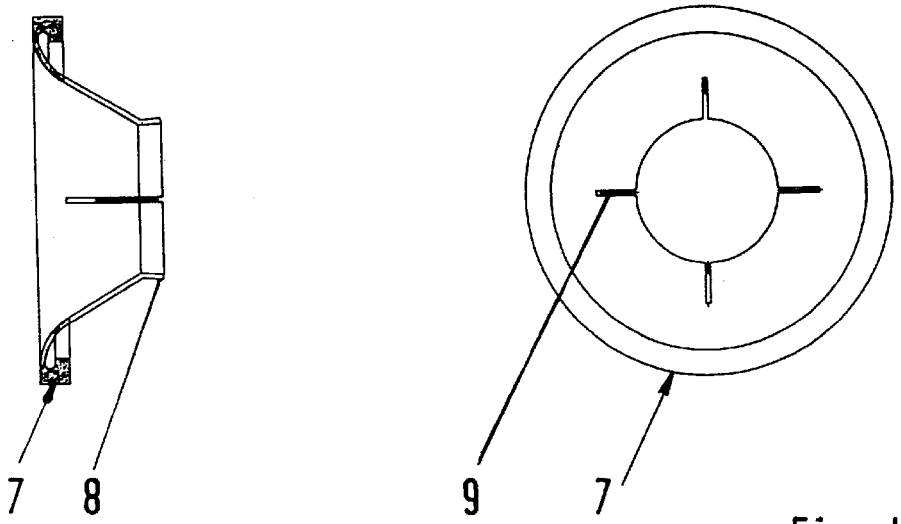
Figure 5:
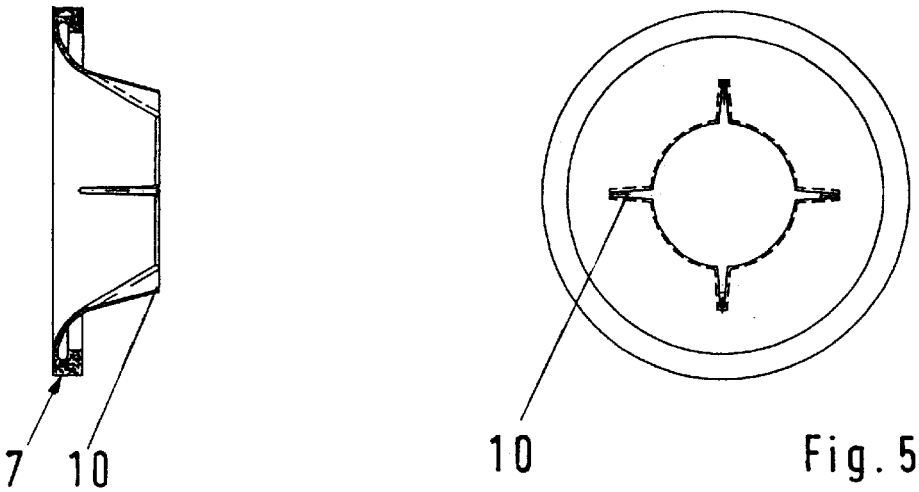

To improve the mobility of the free portion 8 of the sealing lip 7, slits 9 are provided according to FIG. 4, which enhance the movement of the free portions of the sealing lip. The number and size of the slits 9 is chosen according to the pressure conditions in the air intake device and/or the conditions in which the engine is used or the elasticity of the sealing lip 7. In FIG. 5, instead of the slits 9, creases 10 are provided, which assist the opening of the sealing lip in a manner comparable to the slits 9 of FIG. 4.

Figure 6:
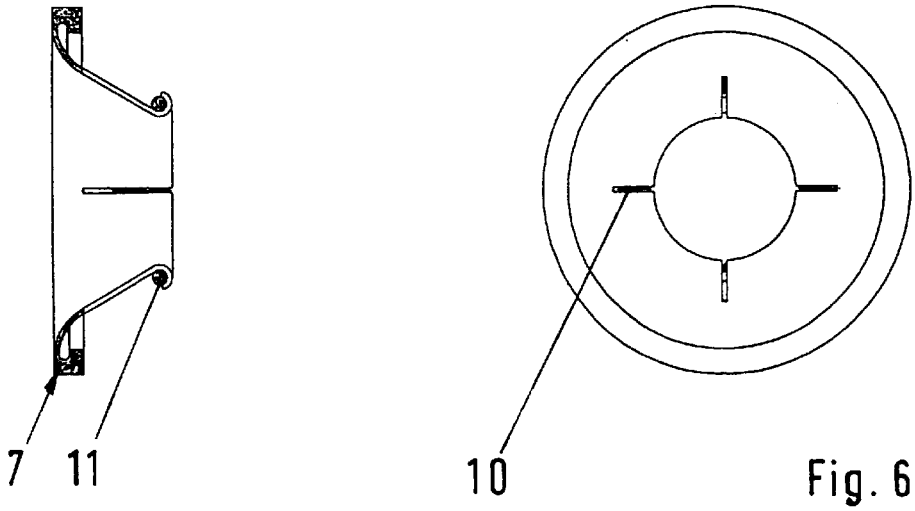

The embodiment in FIG. 6 has, in addition to the slits 9, an annular spring 11 which exerts a given pressure of the sealing lip against the inner tube 3. For certain applications it is necessary to assure a passively controlled opening of the sealing lip 7 to some extent, so that the additional aperture will not be activated until an aspiration pressure established by the action of annular spring 11 is exceeded.

Figure 7:
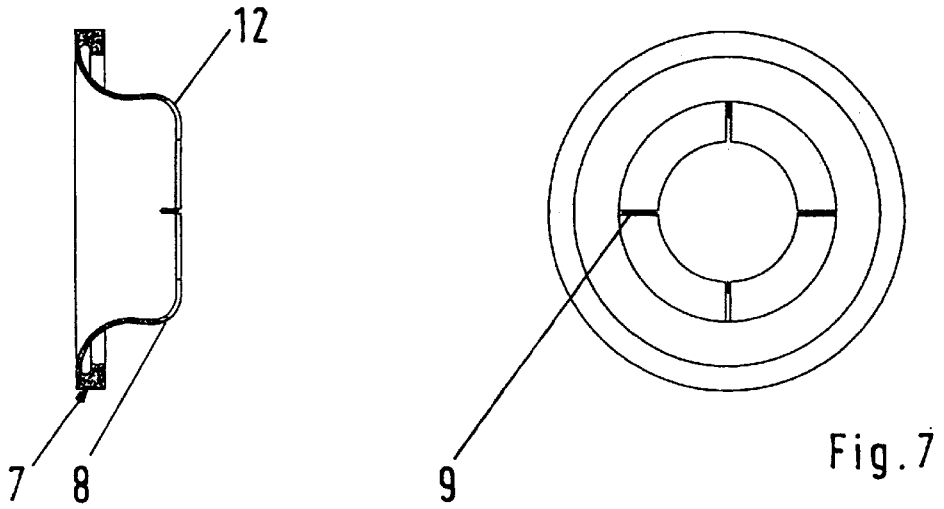
Figure 8:
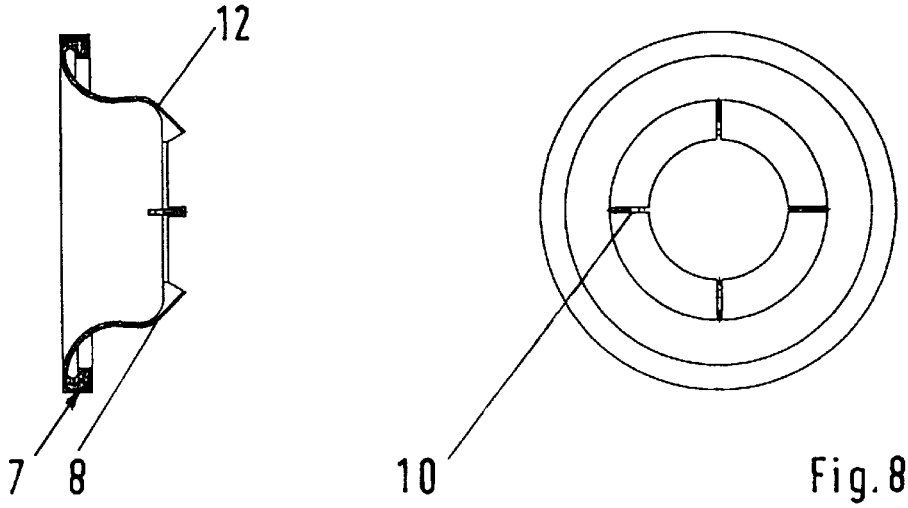

FIG. 7 and FIG. 8 each show an additional embodiment of the sealing lip 7 with a distension or belly-like expansion of the free portion 8, which can have in part a certain stiffness in an area 12. The variation of the aperture is accomplished here too by the provision of slits 9 (FIG. 7) or by creases 10 (FIG. 8).

Figure 9:
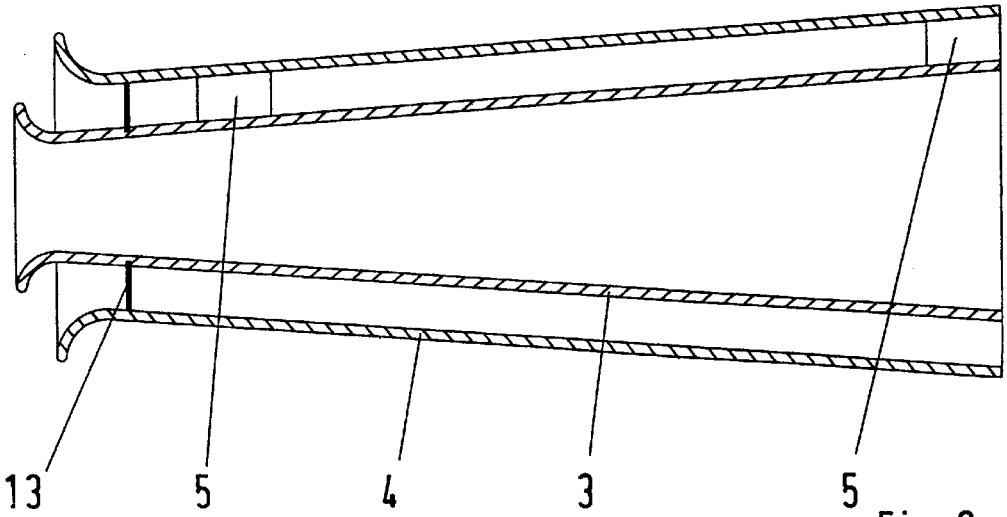
FIGS. 9 to 11 are variant arrangements of the resilient sealing lip.
Figure 10:
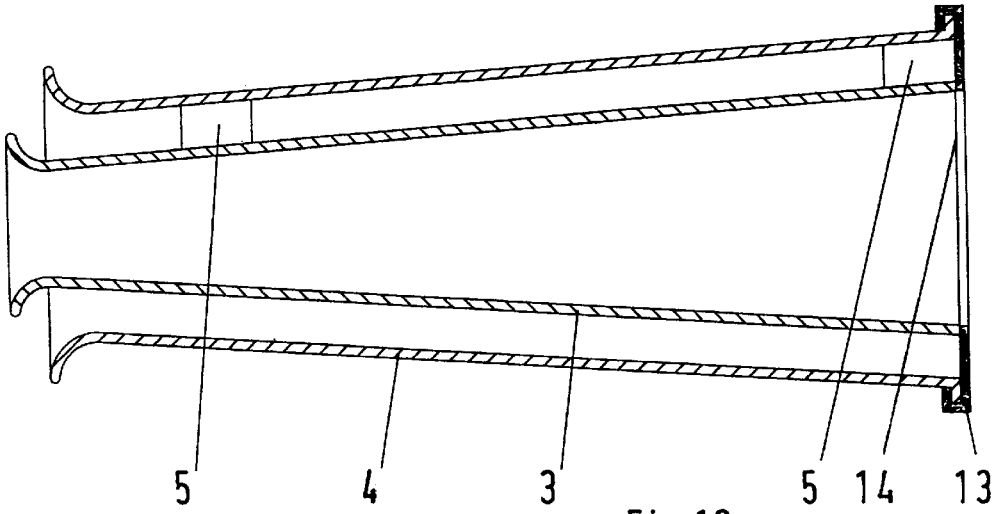
Figure 11:
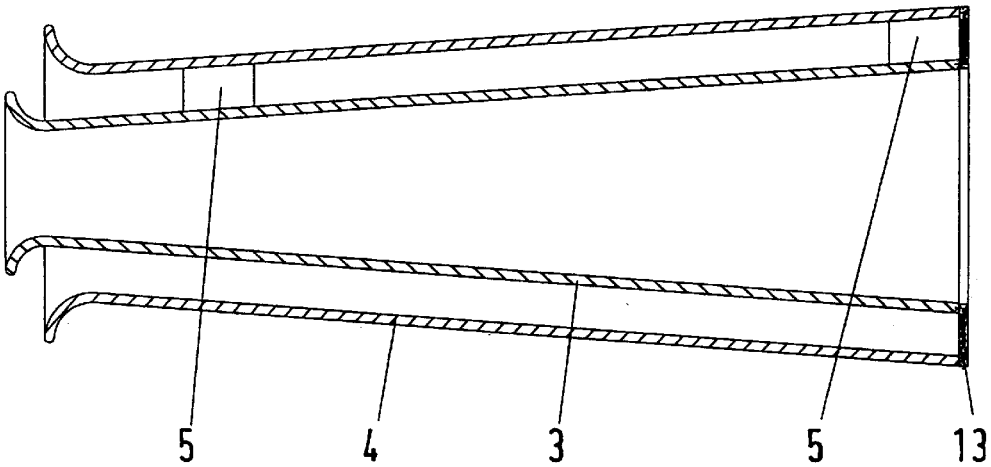

FIG. 9 shows an embodiment of an air intake device 1 with a sealing lip 13 which is fastened to the inner tube 3 with its movable portion against the outer tube 4. Additional embodiments of the sealing lips 13 are to be found in FIG. 10 (fastening to the outer tube 4 at the outlet opening 14) as well as in FIG. 11 (fastening to the inner tube 3 at the outlet opening 14). The structural embodiments of the sealing lips 13 are here adapted to the particular applications and can employ the features described in FIGS. 3 to 8 as regards their movability.

Figure 12:
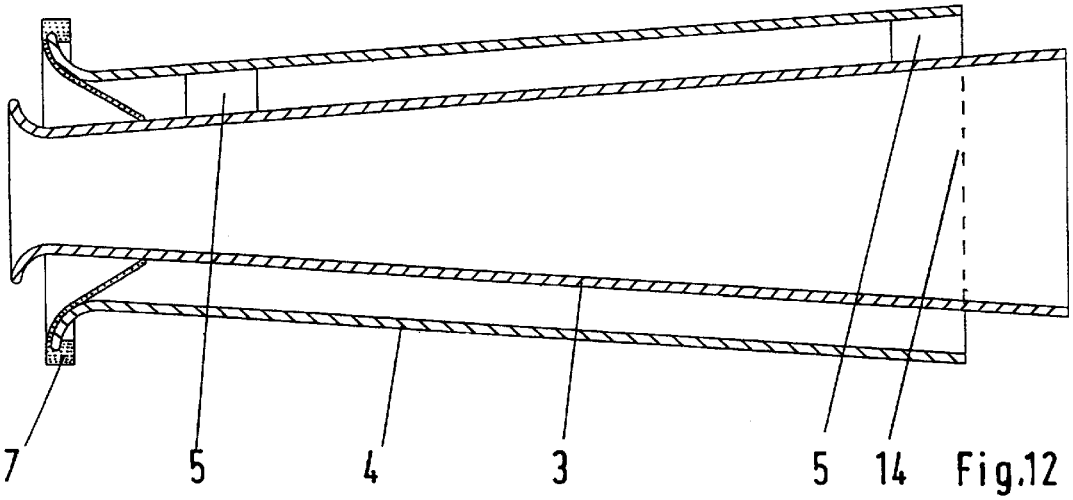
FIGS. 12 and 13 are embodiments of the air intake device with different lengths of the inner tube at the outlet opening.
Figure 13:
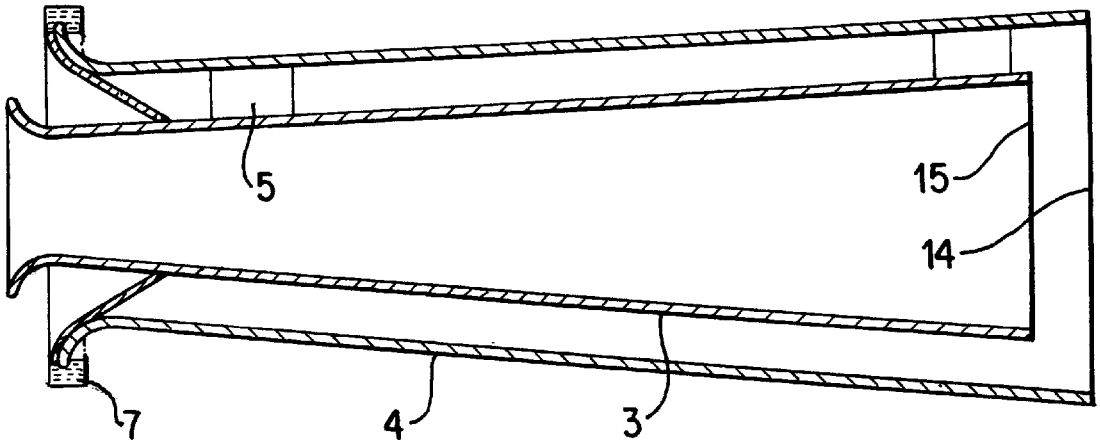

An additional embodiment of the inner tube 3 is shown in FIG. 12, in which the inner tube 3 is extended beyond the plane of the outlet opening 14 in order to assure the most favorable flow pattern at the exit of the air stream. In the embodiment of FIG. 13, line 15 indicates a shortened form of the inner tube 3 in which the inner tube ends before the outlet opening 14. The best configuration in any given case, particularly in regard to noise emission, depends especially on the type of the internal combustion engine requiring the air intake.

We claim:

1. An air intake device for an internal combustion engine, wherein the air intake device has an at least partially variable orifice for adapting the air intake to the operating conditions of the engine; said air intake device comprising an inner tube and an outer tube surrounding the inner tube, said inner tube having an outer surface which is spaced on all sides with respect to the outer tube, and means for shutting off air flow between the inner and outer tubes, whereby in a state of engine operation with a low intake volume, a stream of air is aspirated into the intake device only through the inner tube, and when the intake volume is increased, in addition to the air stream through the inner tube, a further air stream is aspirated through a supplemental intake orifice of variable size between the inner tube and the outer tube.

2. An air intake device for an internal combustion engine, wherein the air intake device has an at least partially variable orifice for adapting the air intake to the operating conditions of the engine; said air intake device comprising an inner tube and an outer tube surrounding the inner tube, said inner tube having an outer surface which is spaced on all sides with respect to the outer tube, and wherein the spacing between the inner tube and the outer tube is fixed by means of radial spacers, and wherein a passive, flap valve mechanism is situated between the inner tube and the outer tube, said flap valve mechanism being responsive to an increase in aspiration pressure to increase the size of the supplemental intake orifice for said further air stream, whereby in a state of engine operation with a low intake volume, a stream of air is aspirated into the intake device only through the inner tube, and when the intake volume is increased, in addition to the air stream through the inner tube, a further air stream is aspirated through the supplemental intake orifice of variable size between the inner tube and the outer tube.

3. An air intake device according to claim 2, wherein the flap valve mechanism comprises a resilient sealing lip mounted on one of said inner tube and said outer tube and extending toward the other of said inner tube and said outer tube, and at least part of said sealing lip being movable away from the other tube to increase the size of the supplemental intake orifice by overcoming a resilient bias of the sealing lip toward the other tube.

4. An intake device according to claim 3, wherein the resilient sealing lip is mounted on the outer tube and extends toward the outer surface of the inner tube.

5. An intake device according to claim 3, wherein the resilient sealing lip is mounted adjacent the intake orifice.

6. An intake device according to claim 3, wherein the resilient sealing lip is mounted adjacent an outlet of the intake device.

7. An intake device according to claim 3, wherein said sealing lip slopes from the one tube toward the other tube in a flow direction of said further air stream.

8. An air intake device according to claim 3, wherein free ends of the flap valve mechanism contact a surface of the other tube.

9. An air intake device according to claim 3, wherein the resilient sealing lip is divided by radially extending slits into a plurality of flap sections.

10. An air intake device according to claim 9, wherein the resilient sealing lip is divided into at least four flap sections.

11. An air intake device according to claim 4, wherein the resilient sealing lip is divided into a plurality of flap sections by slits extending radially from the inner tube toward the outer tube.

12. An air intake device according to claim 4, wherein free ends of the resilient sealing lip are urged by an annular spring against the inner tube.

13. An air intake device according to claim 3, wherein the resilient sealing lip is formed with areas which are distended in a flow direction of the further air stream such that the distended areas exhibit increased stiffness.

14. An air intake device according to claim 1, wherein the inner tube is extended adjacent the intake orifice such that the inner tube protrudes out of the outer tube.

15. An air intake device according to claim 1, wherein the inner tube is extended adjacent an outlet opening of the intake device such that the inner tube protrudes out of the outlet opening.

16. An air intake device according to claim 2, wherein the inner tube is shortened adjacent an outlet opening of the intake device such that the inner tube terminates inside the outer tube.

* * * * *